United States Patent [19]

Blackwell

[11] 4,015,588

[45] Apr. 5, 1977

[54] TAR KETTLE

[75] Inventor: Curtis R. Blackwell, San Antonio, Tex.

[73] Assignee: Reeves Roofing Equip. Co., Inc., San Antonio, Tex.

[22] Filed: June 2, 1976

[21] Appl. No.: 697,934

[52] U.S. Cl. ..... 126/343.5 A; 266/901

[51] Int. Cl.[2] ..... E01C 19/45; F24H 1/00

[58] Field of Search ..... 126/343.5 R, 343.5 A; 37/12; 266/205, 901

[56] References Cited

UNITED STATES PATENTS

| | | | |
|---|---|---|---|
| 287,424 | 10/1883 | Dopp | 126/343.5 A |
| 1,197,745 | 9/1916 | Kinney | 126/343.5 A |
| 1,574,489 | 2/1926 | Kittel | 126/343.5 A |
| 1,855,961 | 4/1932 | Hargrave | 126/343.5 A |
| 3,356,356 | 12/1967 | Kutina | 266/901 X |

*Primary Examiner*—Ronald C. Capossela

[57] ABSTRACT

A pollution control kettle for heating tar and the like and includes a portable tank for containing liquid tar, which tank is provided with a generally vertically extending partition dividing the tank into two adjacent vats. Heaters are provided for selectively heating tar in each of the vats to different temperatures, providing a low temperature vat and a high temperature vat. The partition is provided with at least one opening therethrough which provides free fluid flow between the vats, with the opening being spaced substantially below the normal liquid levels in the tank. The tank is also provided with a closed cover thereon to retard escape of noxious gases and including means for introducing cold tar into said low temperature vat. Means are provided for removing heated tar from the high temperature vat without removing the cover therefrom whereby the tar flows freely from the low temperature vat to the high temperature vat and the escape of noxious gases from the tank is thereby restrained.

4 Claims, 2 Drawing Figures

TAR KETTLE

BACKGROUND OF THE INVENTION

1. Field of the Invention

This invention relates to kettles for heating tar and the like whereby the tar is heated to a temperature sufficient for application to roofs, other structures, or the like.

2. Description of the Prior Art

Portable tar kettles have been provided in the past for the purpose of heating tar for the aforesaid purpose. Such prior art kettles have also been provided with means for heating the tar in the kettle to the desired temperature such that it may be pumped therefrom. It has also been shown in the art to provide covers for such kettles to prevent the escape of noxious gases which are evolved during the heating process. Even so, the prior art kettles have not been fully successful in restraining the production and evolution of the noxious gases and the resulting escape from the kettle.

SUMMARY OF THE INVENTION

It is therefore an object of this invention to provide an improved pollution-control kettle for heating tar and the like, which kettle is arranged such as to reduce the emission of noxious gases from the kettle during the heating process.

Broadly stated, the apparatus of this invention includes a pair of generally adjacent portable vats. Means are provided for selectively heating tar in each of the vats to different temperatures so as to provide a low temperature vat and a high temperature vat. Means are provided for closing the vats to retard escape of noxious gases therefrom. Means are also provided for introducing cold tar into the low temperature vat. The apparatus includes conduit means extending between the vats at a level substantially below the normal liquid levels of the vats for providing free gravity flow of the liquid tar from the low temperature vat to the high temperature vat. The apparatus also includes means for removing heated tar from the high temperature vat without removing the cover means therefrom, whereby the escape of noxious gases from the vats is retarded.

DESCRIPTION OF THE PREFERRED EMBODIMENT

Figure 1:
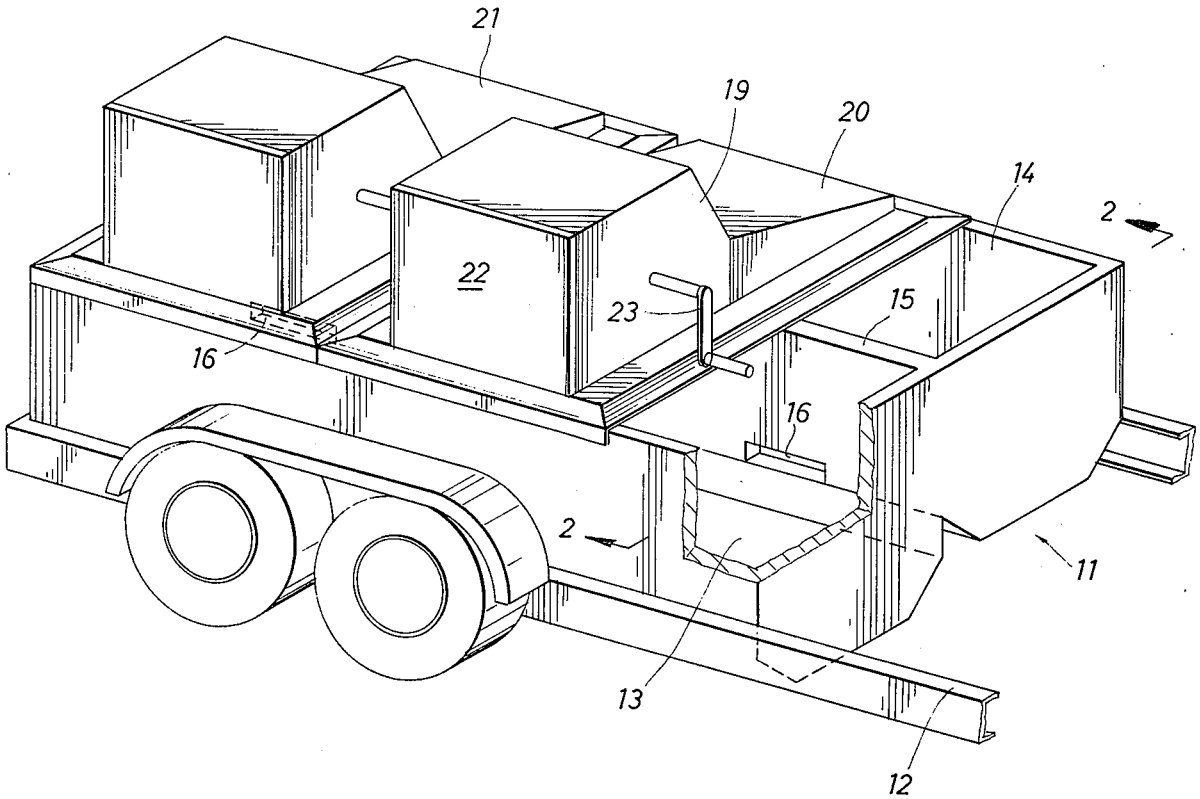
FIG. 1 is the prospective view of one embodiment of the invention showing a portion partly broken away for better viewing.
Figure 2:
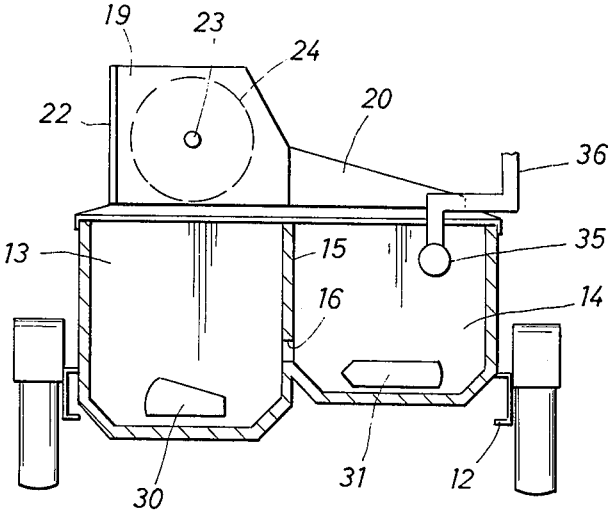
FIG. 2 is a sectional view taken generally along line 2—2 of FIG. 1.

The evolution and the escape of noxious gases from tar kettles has long been a problem as discussed above. It has been discovered, however, that this evolution and escape occurs at an increasing rate with the increase of temperature of the heated tar. The apparatus of this invention provides for separating the low heating step from the high heating step and with the maintenance of a cover over the high temperature vat at all times, both during introduction of tar into the vat and the removal of heated tar therefrom, thereby providing an improved pollution-control kettle, as will now be described.

The numeral 11 generally designates a portable tar tank or kettle shown mounted on trailer frame 12. Kettle 11 is comprised of a pair of generally adjacent vats designated by the numerals 13 and 14 which are formed by a generally vertically extending partition 15 which extends generally longitudenally between the two vats. Partition 15 is provided with a pair of rectangular sluice gates 16 near the bottom thereof and substantially below the usual or normal liquid levels in vats 13 and 14. It will be observed that the sluice gates 16 provides conduit means for free flow of tar from vat 13 into vat 14 by gravity.

Vats 13 and 14 are provided with covers in the form of a pair of similar cover sections 20 and 21. For example, cover 20 has an upwardly extending partition 19 having a hinged cover plate 22 which, when raised, provides access to a rotary air lock 24 which is arranged for turning by crank 23. Hence, upon opening cover 22, cold tar may be introduced into vat 13 through air lock 24 with little possibility of escape of noxious gases therefrom.

Means are provided for heating vats 13 and 14 to different temperatures and these take the form of a heating element 30 of conventional design arranged for support along the bottom portion of vat 13. Heating element 30 is arranged for heating the liquid in vat 13 to a pre-determined level on the order of 300°–350° F. Vat 14 is also provided with a similar heating element 31 which is similarly arranged for heating of tar in vat 14 to a pre-determined level, as an example, on the order of 500° F, which is considered the usual normal working temperature for a conventional vat and a temperature desired to provide the liquid tar of a desired viscosity. Means are provided for removing heated liquid tar from vat 14 without removing covers 20 and 21 therefrom and this means takes the form of a tar pump 35 of conventional design which is arranged to remove tar from kettle 14 through appropriate riser pipe 36.

In operation portable tank or kettle 11 is initially charged with cold tar so as to fill preheat vat 13 where it is heated to the extent desired by heating element 30, such that tar can flow by gravity through sluice gates 16 to high temperature vat 14. Additional cold tar is then introduced into preheat vat 13 through air lock 24, which processes continue until the liquid tar level in vats 13 and 14 reaches the desired working level. As the liquid tar flows into vat 14, it is contacted by the hotter heating element 31 so as to raise the temperature of liquid tar in vat 14 to the desired temperature range as discussed above. At this point, operation of pump 35 is arranged to remove tar from vat 14 through riser pipe 36 so as to deliver it to the desired location for application in the usual fashion. Cold tar is continued to be added through air lock 24 to preheat vat 13 where it is heated and flows by gravity through sluice gates 16 to high temperature vat 14.

It is readily observed that the cover provided by covers 20 and 21 remain in place over high temperature vat 14 at all times thereby retarding the escape of noxious gases therefrom. Moreover, by the introduction of cold tar to air lock 24 into preheat vat 13, the overall escape of noxious gases is further retarded because the evolution of noxious gases in preheat vat 13 is substantially less than that which is normally experienced with high temperature vat 14. High temperature vat 14 remains closed at all operating times since the liquid level in vats 13 and 14 provides a closed atmosphere above the liquid level of the tar in vat 14 which thereby retards escape of noxious gas therefrom. The positioning of sluice gates 16 below the liquid level of vats 13 and 14 prevents the escape of noxious gases from vat 14 to vat 13.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiment. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. In a pollution-control kettle for heating tar and the like, the combination comprising:

a pair of generally adjacent portable vats;

means for selectively heating tar in each of said vats to different temperatures so as to provide a low temperature vat and a high temperature vat;

means for providing closed covers for said vats to retard escape of noxious gases therefrom;

means for introducing cold tar into said low temperature vat;

conduit means extending between said vats at a level substantially below the normal liquid levels of said vats for providing free gravity flow of liquid tar from said low temperature vat to said high temperature vat;

and means for removing heated tar from said high temperature vat without removing said cover means therefrom, whereby the escape of noxious gases from said vats is retarded.

2. In a pollution-control kettle for heating tar and the like, the combination comprising:

a portable tank for containing liquid tar;

a generally vertically extending partition dividing said tank into two adjacent vats;

means for selectively heating tar in each of said vats to different temperatures so as to provide a low temperature vat and a high temperature vat;

said tank having a closed cover thereon to retard escape of noxious gases and including means for introducing cold tar into said low temperature vat;

said partition having at least one opening therethrough so as to provide free fluid flow between said vats, said opening being spaced substantially below the normal liquid level in said tank;

and means for removing heated tar from said high temperature vat without removing said cover, whereby said tar flows by gravity from said low temperature vat to said high temperature vat and the escape of noxious gases from said tank is thereby restrained.

3. The invention as claimed in claim 2 wherein:

said opening in said partition is spaced near the bottom of said vats.

4. The invention as claimed in claim 2 wherein:

said partition is provided with a plurality of said openings.

* * * * *